US007581801B2

(12) United States Patent
Oike

(10) Patent No.: US 7,581,801 B2
(45) Date of Patent: Sep. 1, 2009

(54) IMAGE FORMING APPARATUS

(75) Inventor: Hikaru Oike, Ibaraki-ken (JP)

(73) Assignee: Riso Kagaku Corporation, Tokyo (JP)

( * ) Notice: Subject to any disclaimer, the term of this patent is extended or adjusted under 35 U.S.C. 154(b) by 261 days.

(21) Appl. No.: 11/730,829

(22) Filed: Apr. 4, 2007

(65) Prior Publication Data

US 2007/0297823 A1 Dec. 27, 2007

(30) Foreign Application Priority Data

Apr. 7, 2006 (JP) ..... P2006-106252

(51) Int. Cl.
*B41J 29/38* (2006.01)

(52) U.S. Cl. ..... 347/14; 347/19

(58) Field of Classification Search ..... 347/14, 347/19, 116
See application file for complete search history.

(56) References Cited

U.S. PATENT DOCUMENTS 5,995,802 A * 11/1999 Mori et al. ..... 399/394

FOREIGN PATENT DOCUMENTS

JP 03-002067 1/1991
JP 03-002068 1/1991
JP 10-186787 7/1998
JP 2000-356875 12/2000
JP 2004-188921 7/2004
WO 03/082587 A1 10/2003

* cited by examiner

*Primary Examiner*—Thinh H Nguyen
(74) *Attorney, Agent, or Firm*—The Nath Law Group; Jerald L. Meyer; Sung-Yeop Chung

(57) ABSTRACT

An image-forming apparatus has: a transfer belt transferring a sheet; an encoder outputting a pulse signal in response to a rotational motion of the transfer belt; a belt reference sensor detecting a belt reference mark provided on the transfer belt; a first accumulator measuring a rotational position of the transfer belt against the reference mark by counting a pulse signal; a storage unit storing a table of printing timing correction values for one rotational cycle of the transfer belt; a second accumulator generating a printing timing signal by shifting a phase of the pulse signal by a printing timing correction value read from the table; and a image-forming unit controlling ink heads to eject inks on the sheet in synchronization with the printing timing signal, wherein an error in transfer amount of the sheet is calculated from a fluctuation in an interval of the inks ejected from the ink heads.

4 Claims, 16 Drawing Sheets

IMAGE FORMING APPARATUS

BACKGROUND OF THE INVENTION

1. Field of the Invention

The present invention relates to image-forming apparatuses with ink-eject heads that enable to eject inks to form images on image-formed media.

2. Description of Related Art

There has been widely used an ink-jet recording apparatus as recording means for recording images on image-formed media, such as paper, based on image information. The ink-jet recording apparatus is usually applied on printers, facsimiles or copying machines, and the recording images include characters or symbols in general.

During the recording of images, however, the landing of ink droplets from respective ink-eject heads tends to deviate from predetermined positions. This will be below called the "landing misalignment". The landing misalignment is divided into two components: the DC component that shifts with at a constant amount; and the AC component that fluctuates periodically.

The AC component of a landing misalignment is caused by unevenness in the thickness of a belt or unevenness in the radius of a roller. In order to reduce a landing misalignment with the circumferential length of a belt as one cycle due to the former unevenness or a landing misalignment with the circumferential length of a roller as one cycle due to the latter one, the following methods have been conventionally proposed. Note here that the former cycle will be below called the "belt cycle" and the latter called the "roller cycle".

[Landing Misalignment with Belt Cycle]

(1-1) There is proposed a method to enlarge the diameter of a roller or reduce the thickness of a belt so as to make unevenness in the thickness of the belt relatively small. The former, however, makes an image forming device or its components large and heavy and the latter makes its endurance weak. This method can reduce but cannot eliminate a landing misalignment.

(1-2) There is proposed a method to measure the rotation speed of a belt by bringing a roller into contact with the surface of the belt without any influence of unevenness in the thickness of the belt.

Japanese Patent Publication Laid-open No. 2004-188921 discloses a method to measure the thickness of a belt using a laser Doppler measurement device.

The measurement of the rotation speed of a belt at a contact line of the roller and belt, however, frequently gets false detection due to slide or vibrations. Increasing the pressure of the roller to prevent the slide causes the deformation of the belt. Accordingly, the measurement receives some influence of unevenness in the thickness or elasticity of the belt. Also, the laser Doppler measurement device is quite expensive. Moreover, these methods get detection error due to paper dust or ink-mist.

(1-3) Japanese Patent Publication Laid-open No. 2000-356875 discloses a method to measure the thickness of a belt in advance and to adjust a recording timing or transfer speed based on obtained data. This method, however, requires a thickness measurement device with high-accuracy so as to accumulate minute unevenness in thickness. Moreover, when a multilayer belt is used, this method cannot deal with landing misalignments other than that due to unevenness in thickness.

(1-4) Japanese Patent Publication Laid-open No. H10-186787 discloses a method to measure and correct unevenness in the thickness of a belt by reading a registered pattern on the belt surface at a position different from recording positions. This, however, requires reading means with high-accuracy and high-speed. In addition, the measuring ability of the reading means decreases due to paper dust or ink-mist.

[Landing Misalignment with Roller Cycle]

(2-1) Japanese Patent Publication Laid-open No. H03-2067 discloses a method to eliminate a landing misalignment with a roller cycle by adjusting intervals between image-recording units to the roller cycle. This method, when combined with the method (1-1) or (1-2), enables to reduce the landing misalignment due to the unevenness of a belt and roller.

When the method (2-1) is combined with the method (1-1), an image-forming device is made large because it also requires widening an interval between ink heads. This causes to degrade the accuracy of the manufacturing dimension of head mounting units and to increase the deformation of these units. Also, when the method (2-1) is combined with the method (1-2), it cannot solve the problem of the method (1-2) itself.

Japanese Patent Publication Laid-open No. H03-2068 discloses a method to resolve unevenness with a belt cycle by using the method (1-2) and unevenness with a roller cycle by storing the roller cycle and performing correction. However, this method cannot solve the problem of the method (1-2), either.

SUMMARY OF THE INVENTION

An object of the present invention is to eliminate the AC component of a landing misalignment due to unevenness in the thickness of a belt or unevenness in the radius of a roller.

To achieve the above described object, the first aspect of the present invention provides an image-forming apparatus comprising: a transfer unit (for example, a transfer belt according to the first embodiment) that transfers an image-formed medium by rotation thereof; an image-forming unit that includes a first ink head and a second ink head (e.g. ink heads K, C according to the first embodiment) arranged in a transfer direction of the image-formed medium at a predetermined interval and controls the first ink head and the second ink head to eject first and second inks on the image-formed medium; a transfer amount detecting unit (e.g. an encoder according to the first embodiment) that outputs a pulse signal in response to a rotational motion of the transfer unit; a transfer reference position detecting unit (e.g. a belt reference sensor according to the first embodiment) that detects a reference position provided on the transfer unit; an ink landing position calculating unit (e.g. a first accumulator according to the first embodiment) that calculates an ink landing position corresponding to the reference position on the image-formed medium by counting a pulse signal after detection of the reference position; a storage unit that stores correction values for printing timing for one rotational cycle of the transfer unit as a correction table; and a printing timing signal generating unit (e.g. a second accumulator according to the first embodiment) that reads out a correction value for printing timing, which corresponds to the ink landing position on the image-formed medium, from the correction table and generates a printing timing signal by shifting a phase of the pulse signal by the correction value for printing timing; wherein the correction table includes a set of values, each value being calculated based on a measurement value of an interval between a first ink landing position by the first ink head and a second ink landing position by the second ink head in a predetermined image pattern formed on the predetermined image-formed media which are corresponding to a length longer than the one rotational cycle of the transfer unit, and canceling an error of a transfer amount of the predetermined image-formed media by the transfer unit, and wherein the image-forming unit forms an image on the image-formed medium in transfer by controlling the first and second ink heads to eject respective inks in synchronization with the printing timing signal.

DETAILED DESCRIPTION OF THE PREFERRED EMBODIMENTS

Referring to Figures, several embodiments of the invention will be below explained.

First Embodiment

Figure 1:
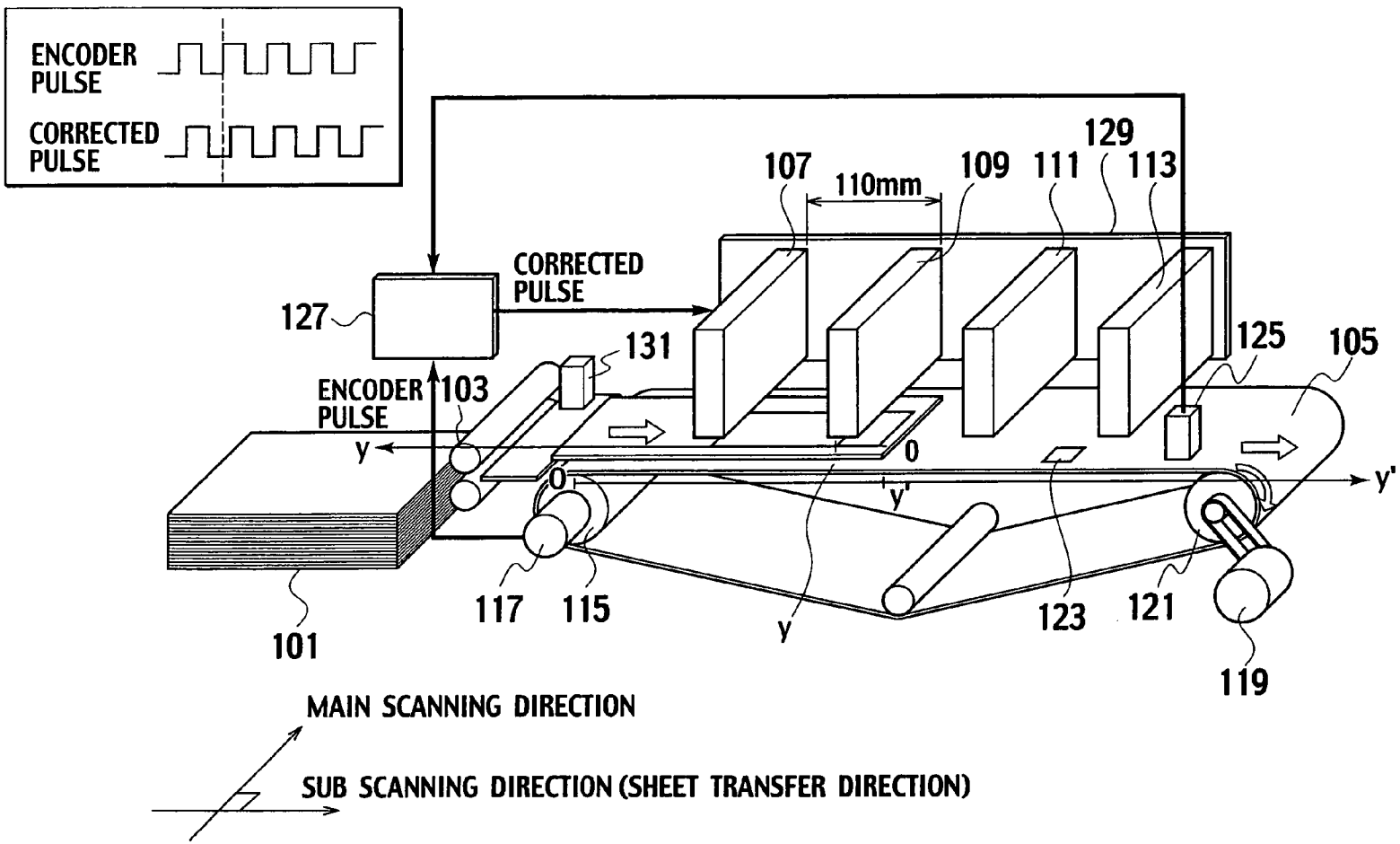
FIG. 1 is a schematic view of an image-forming apparatus according to the first embodiment of the present invention.

FIG. 1 is a schematic view of an image-forming apparatus according to the first embodiment of the present invention. The transfer of sheets is performed in the following steps:

(1) Picking up a sheet from a paper feeding tray 101 to transfer the sheet to a register roller 103 at rest;

(2) Hitting a tip end line of the sheet to the register roller 103 at rest for correcting a landing misalignment in a sub scanning direction;

(3) Rotating the register roller 103 and transferring the sheet to a transfer belt 105 at a speed faster than that of the transfer belt 105;

(4) Transferring the sheet to right of a sub scanning direction in a stuck state over the transfer belt 105 by a negative pressure from an absorbing fan (not shown) just below the transfer belt 105;

(5) Sequentially printing an image on the sheet with a plurality of line ink-jet heads (ink heads), K (black) 107, C (cyan) 109, M (mazenda) 111 and Y (yellow) 113, aligned above the transfer belt 105; and (6) Discharging the sheet to a paper receiving tray (not shown) on the right of the transfer belt 105.

[Specification of Units]

The circumferential length of the transfer belt 105 in the sub-scanning direction is 1275 mm, the thickness is 0.45 mm, and the width in the main-scanning direction is 355 mm;

The diameter of a driven roller 115 is ϕ40 mm; and

The pulse number of a rotary encoder (encoder) 117 is 1500 ppr (pulse/round), the pulse array cycle is 84.67 μm (≅300 dpi), and the interval between neighboring ink heads is 110 mm.

During the steps (3)-(5), the step (1) is started for another sheet. Since this shortens a sheet transfer interval, the number of sheets printed per time is increased. Printing an image on a sheet with each ink head is synchronized to a pulse series of the encoder 117, which is provided along the axis of the driven roller 115. Accordingly, no influence is given on the image from unevenness in the rotation of a driving roller 121 driven by a driving motor 119. However, the landing misalignment of each color ink occurs with the circumferential length of the transfer belt 105 as a belt cycle. This is so called the "AC component of the landing misalignment". The transfer belt 105 has a belt reference mark 123 on a surface thereof. The belt reference mark 123 is detected by a belt reference sensor 125. Signals from the encoder 117 and the belt reference sensor 125 are sent to a correction circuit 127. The correction circuit 127 outputs a driving signal to a head driving circuit 129. A sheet tip sensor 131 measures a tip end line of the sheet. Ink heads 107, 109, 111, and 113 respectively have six ink heads of 2-inch each arranged in a houndstooth check shape.

Figure 2:
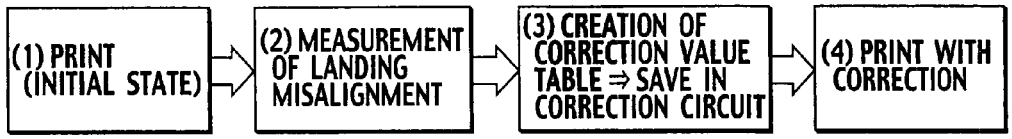
FIG. 2 is a view of steps for correcting a landing misalignment.

FIG. 2 shows the following steps for correcting the landing misalignment of each ink color:

(1) Printing an image on a sheet in an initial state, and in particular, sequentially printing a predetermined image pattern on a plurality of sheets with their total length longer than a belt rotational cycle (in this case, three A3 sheets with the length of 420 mm and the interval between neighboring sheets of 50 mm);

(2) Measuring the landing misalignment amount of each color ink, and in particular, reading the landing misalignment amount of each color ink relative to that of a reference color ink on the sheets by an external or device-equipped scanner;

(3) Creating a table of correction values (correction table) 37 based on the measurement results and storing this table within the correction circuit 127; and (4) Printing the predetermined image pattern on the sheets with correcting the AC component of the landing misalignment by generating a timing signal that is an encoder pulse signal with a phase shifted based on the correction table 37 stored in the correction circuit 127.

Here, the predetermined image pattern is a pattern for analyzing an amount of color misalignment on an image-forming device such as an ink-jet. The international publication WO2003/082587 discloses a test chart as such a pattern in FIG. 8.

[Outline of Correction Circuit]

Figure 3:
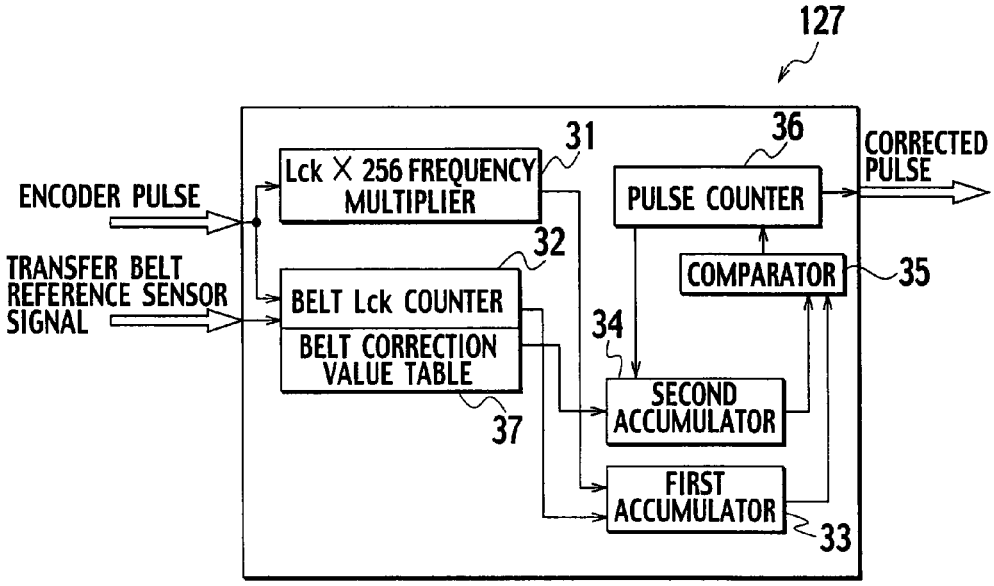
FIG. 3 is a schematic view of the internal structure of a correction circuit according to the first embodiment.
Figure 4:
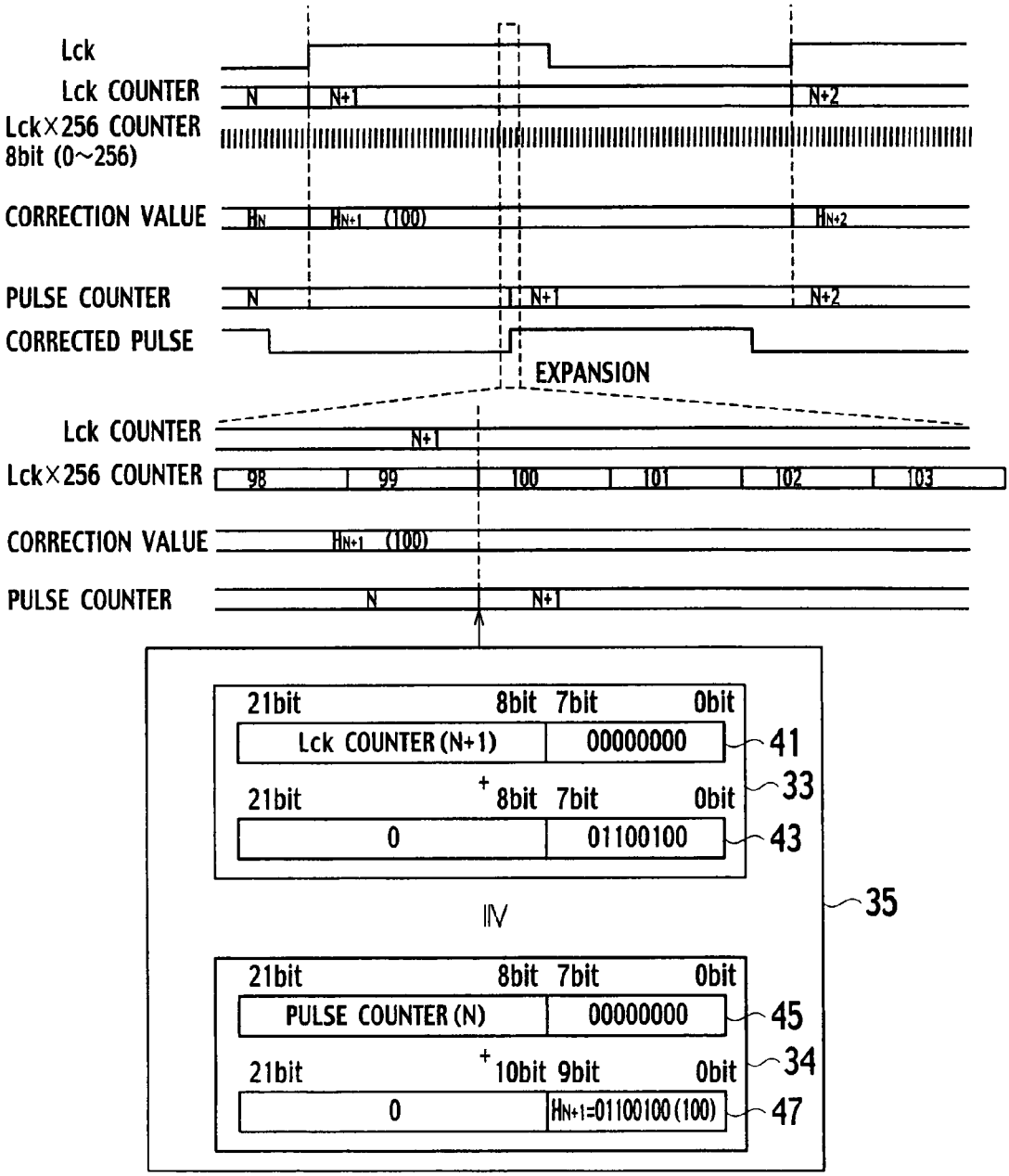
FIG. 4 is a view of operations of the correction circuit according to the first embodiment.

FIG. 3 shows the internal structure of the correction circuit 127 and FIG. 4 shows operations of the correction circuit 127. According to FIGS. 3 and 4, there is explained an example of operations of the correction circuit 127.

[Specification of Phase Shifting of Encoder Pulse at Correction Circuit]

The phase shifting ability is as follows: the dividing ability is 1/256 pulse (0.33 μm) with data of 10 bits per point; the shift range is 0~3.996 pulses (0~338.34 μm).

The total volume of the correction table 37 is 640 bits according to 1387 mm, that is, every 256 lines (about 21.7 mm)×64 sections.

There is explained the internal structure of the correction circuit 127.

The correction circuit 127 comprises an Lck counter (not shown), an Lck×256 frequency multiplier 31, a belt Lck counter 32, a first accumulator 33, a second accumulator 34, a comparator 35, a pulse counter 36, and the correction table 37.

The Lck×256 frequency multiplier 31 generates 256 signals in one cycle of a signal "Lck" and counts them. Here, "Lck" is a pulse signal with a same phase as an encoder phase A generated per one printing cycle (300 dpi).

The belt Lck counter 32 is a counter for measuring a current position (of the belt reference mark 123) of the transfer belt 105 in a rotating state. A correction value corresponding to the measured current position of the transfer belt 105 is selected from the correction table 37.

The first accumulator 33 adds a counted value of the Lck counter and a counted value of the Lck×256 frequency multiplier 31.

The second accumulator 34 adds a correction value of the correction table 37 to a value of a counted value of the pulse counter 36 plus 1.

The comparator 35 compares the added value of the first accumulator 33 and that of the second accumulator 34. When the former value is greater than or equal to the latter value, the comparator 35 outputs a corrected pulse to the pulse counter 36.

The pulse counter 36 outputs the corrected pulse and counts up its own value.

Referring to FIG. 4, the above described "addition" and "comparison" operations are explained in detail.

The first accumulator 33 adds "a shifted value 41 of the counted value (N+1 in this example) of the Lck counter by 8 bits to the left" and "the counted value 43 of the Lck×256 frequency multiplier 31". The second accumulator 34 adds "a shifted value 45, (N+1), of the counted value (N) of the pulse counter 36 plus 1 by 8 bits to the left" and "the correction value (the counted value of the Lck×256 frequency multiplier 31) 47, 01100100, (corresponding to $H_{N+1}$=100)". The comparator 35 compares the added value of the first accumulator 33 and that of the second accumulator 34. If the former value is more than or equal to the latter value, the comparator 35 outputs the corrected pulse.

The above described structure enables to shift the phase of an encoder pulse based on the position of the transfer belt 105 and the correction values of the correction table 37.

[Method of Creating Correction Table]

There is explained a method to create the correction table 37 from a landing misalignment due to unevenness in the thickness of the transfer belt 105.

Figure 5:
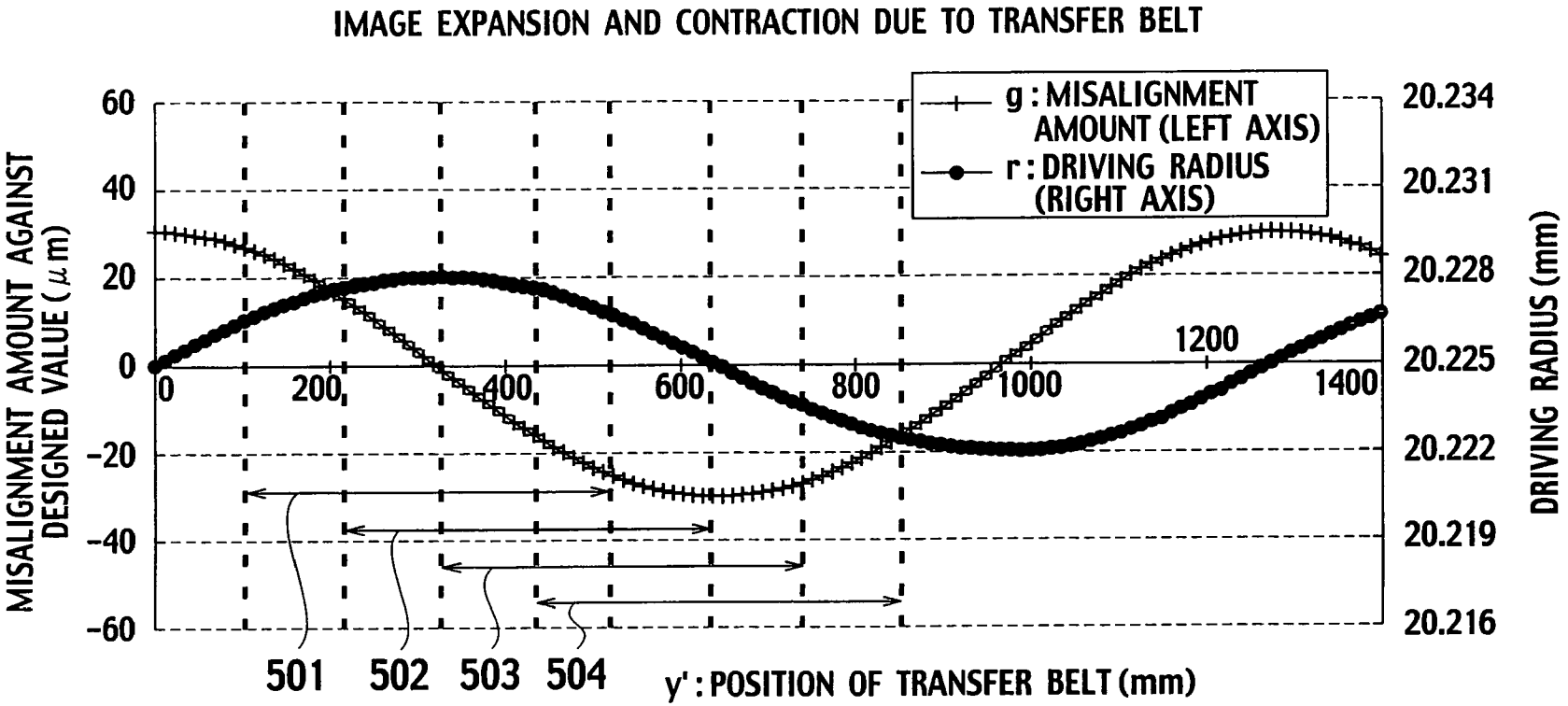
FIG. 5 is a view of a landing misalignment amount "g" at a position "y'" of a transfer belt when the driving radius "r" [mm] of a driven roller fluctuates in a sine wave form with the circumferential length of the transfer belt as one cycle.

Now define "y'"[mm] as a distance (position) from a predetermined fixed (static) reference position "O" to the belt reference mark 123 of the transfer belt 105 in a sheet transfer direction (see FIG. 1), and set the circumferential length "L" of the transfer belt 105 as 1275 mm. This definition is equivalent to define "y'" as a distance from the belt reference sensor 125 to the belt reference mark 123 of the belt transfer belt 105 in the transfer direction, but this definition will be below used for explanation as a matter of convenience. FIG. 5 shows a landing misalignment amount "g" at a position "y'" of the transfer belt 105 when the driving radius "r" [mm] of the driven roller 115 fluctuates in a sine wave form with the belt cycle.

Supposing the average radius of the driven roller 115 as 20.225 mm and the amplitude as ±3 μm, we can represent the driving radius r(z')[mm] at a position "z'"[mm] of the transfer roller 105 as $$r(z') = 20.225 + 0.003\ \sin\left(2\pi \cdot \frac{z'}{1275}\right). \tag{1}$$

Thus, when the transfer belt 105 moves from the static reference position "O" to a position "y'"[mm], the transfer amount G(y')[mm] of a sheet is obtained by $$\begin{aligned} G(y') &= \int_0^{y'} r(z')\,dz' = \int_0^{y'} \left\{20.225 + 0.003\ \sin\left(2\pi \cdot \frac{z'}{1275}\right)\right\} dz' \\ &= 20.225y' + \frac{1275}{2\pi} \cdot 0.003\left\{1 - \cos\left(2\pi \cdot \frac{y'}{1275}\right)\right\} \\ &= 20.225y' + \frac{1275}{2\pi} \cdot 0.003 - \frac{1275}{2\pi} \cdot 0.003\cos\left(2\pi \cdot \frac{y'}{1275}\right). \end{aligned} \tag{2}$$

Accordingly, the landing misalignment amount "g"[mm] at the position "y'"[mm] of the transfer belt 105 is given by $$\begin{aligned} g(y') &= 20.225y' + \frac{1275}{2\pi \cdot 20.225} \cdot 0.003 - \\ G(y') &= \frac{1275}{2\pi \cdot 20.225} \cdot 0.003\cos\left(2\pi \cdot \frac{y'}{1275}\right). \end{aligned} \tag{3}$$

Since the pulse number of the encoder 117 is 1500 ppr and the average of a driving radius r(y') is 20.225 mm, the average interval of neighboring dots (average printing interval) is given by 84.718 μm (=20.225×2π/1500). When this value is set as a dot interval in design (target), the landing misalignment amount "g"[mm] from a dot position in design is represented by (3).

Thus, it is considered the integration value of the deviations of the driving radius "r" from the average radius in the transfer direction of the transfer belt 105 as a landing misalignment amount (that is, the expansion and contraction of an image) from a value in design.

For example, in FIG. 1, when an A3 sheet (length 420 mm) is transferred lengthwise on the transfer belt 105 from the left hand and the printing of the predetermined image pattern on the sheet is started with the ink head "K" arranged above the position y'=100 mm of the transfer belt 105, the printing range of each color ink, which depends on the ink head positions (interval: 110 mm) of K, C, M and Y, is as follows:

Printing range of K: 100 mm≦y'≦520 mm (line 501 in FIG. 5);

Printing range of C: 210 mm≦y'≦630 mm (line 502 in FIG. 5);

Printing range of M: 320 mm≦y'≦740 mm (line 503 in FIG. 5); and

Printing range of Y: 430 mm≦y'≦850 mm (line 504 in FIG. 5).

Figure 6:
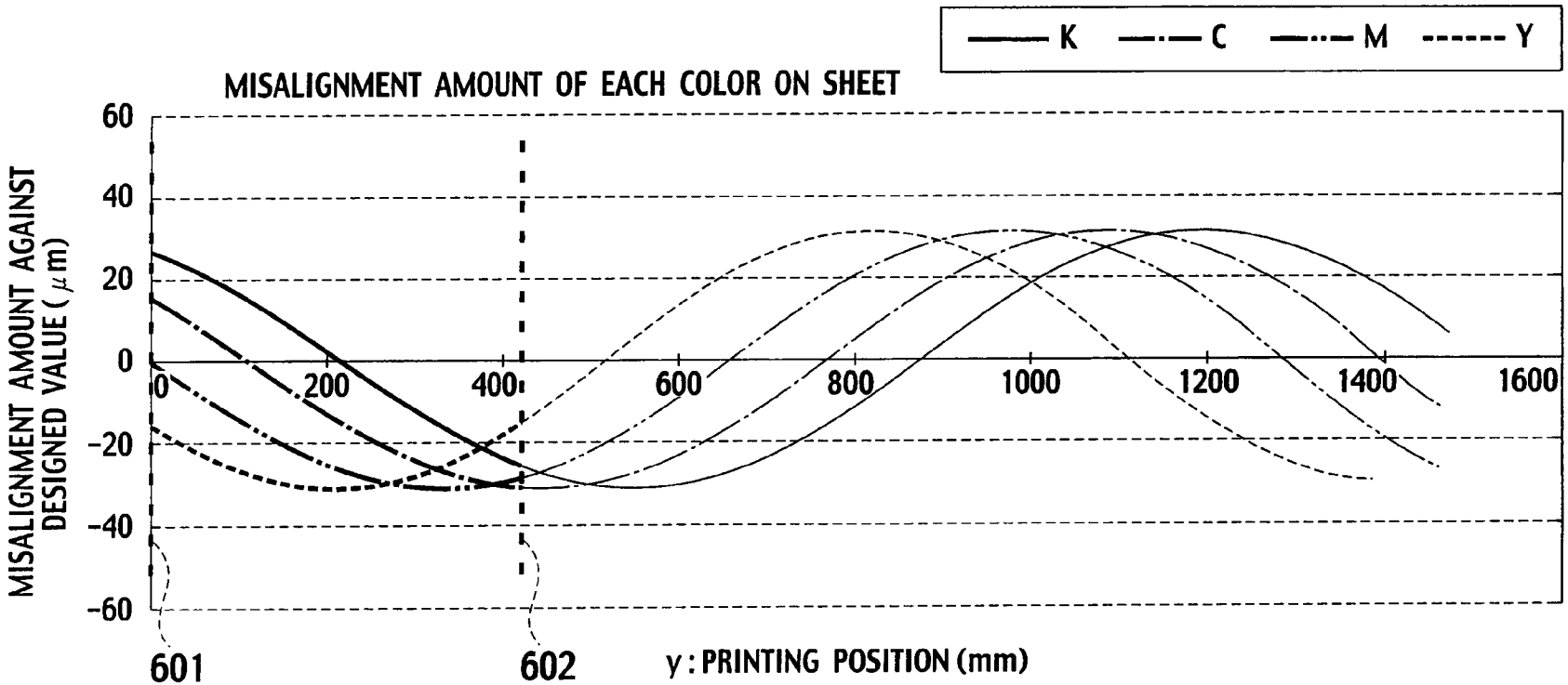
FIG. 6 is a view of the landing misalignment amounts of the color inks K, C, M and Y from a value in design at a printing position.

The next step is to conform the landing misalignment amounts K(y), C(y), M(y) and Y(y) of K,C,M and Y to each other at a printing position "y" of an A3 sheet, that is, K(y)=C(y)=M(y)=Y(y). As shown in FIG. 1, "y" is a position measured backward from a tip end line of the A3 sheet in the transfer direction. Then, as shown in FIG. 6, K(y), C(y), M(y) and Y(y) at a dot position "y" in design are represented by $$K(y)=g(y+100), \tag{4-1}$$

$$C(y)=g(y+210)=K(y+110), \tag{4-2}$$

$$M(y)=g(y+320)=K(y+220), \tag{4-3}$$

$$Y(y)=g(y+430)=K(y+330). \tag{4-4}$$

In FIG. 6, the interval from a dotted line 601 to a dotted line 602 corresponds to the length of an A3 sheet. Note here that g(y+100) in (4-1) is obtained by substituting y'=y+100 into (3) (See FIG. 1).

It is possible to specify a position "y" of the transfer belt 105 to which the position "y" of a point of the predetermined image pattern on the A3 sheet corresponds from a positional relationship between the register roller 103 and each ink head. This is achieved by starting the rotation of the register roller 103 to transfer the A3 sheet to the transfer belt 105 in the instance when the belt reference mark 123 passes through the belt reference sensor 125. This is still achieved by starting the rotation when particular counts of encoder pulse are generated after the belt reference mark passes through the belt reference sensor 125.

Suppose here that KC(y) represents the landing misalignment amount of K relative to that of C at a dot position "y" in design; KM(y) the landing misalignment amount of K relative to that of M; and KY(y) the landing misalignment amount of K relative to that of Y.

Figure 7:
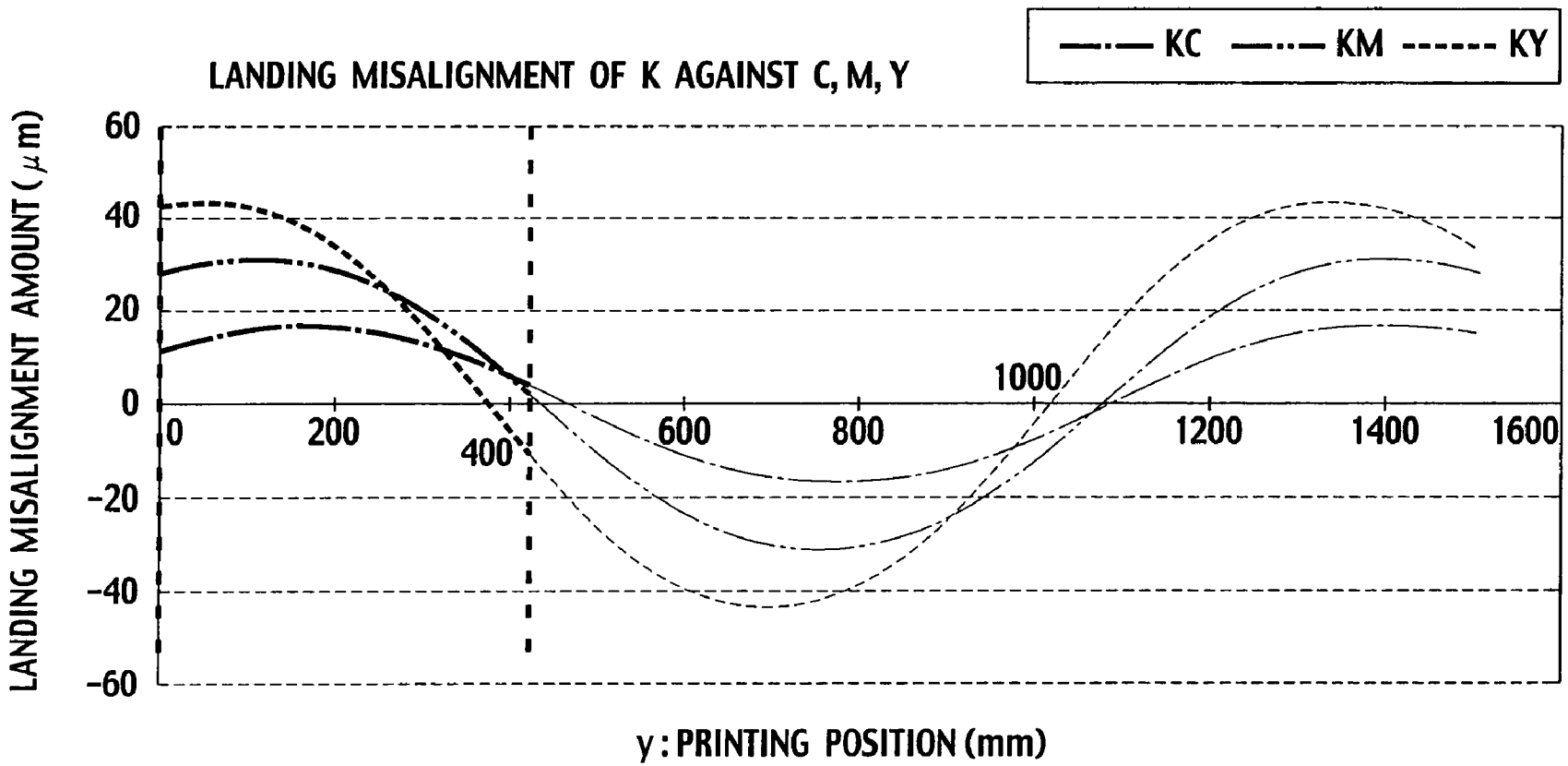
FIG. 7 is a view of the landing misalignment amount of K relative to these of C, M and Y at a printing position.

As shown in FIG. 7, they are expressed as $$KC(y)=K(y)-C(y)=K(y)-K(y+110)=g(y+100)-g(y+210), \tag{5-1}$$

$$KM(y)=K(y)-M(y)=K(y)-K(y+220)=g(y+100)-g(y+320), \tag{5-2}$$

$$KY(y)=K(y)-Y(y)=K(y)-K(y+330)=g(y+100)-g(y+430) \tag{5-3}$$

KY(y) tends to be the largest in them since the ink-head interval between K and Y is the widest. The landing misalignment amount changes depending on a sheet position.

Accordingly, if a landing misalignment amount g(y') with the belt cycle of the transfer belt 105 is obtained from (3), it is possible to make KC(y), KM(y) and KY(y) zero, that is K(y)=C(y)=M(y)=Y(y), by setting the values of the correction table 37 as −g(y').

Next, to get g(y) from K(y) using the measurement value KC(y), solving the recurrence equation (5-1), K(y+110)=K(y)−KC(y), with y=110n, we obtain $$\begin{aligned} K(110) &= K(0) - KC(0), \\ K(220) &= K(110) - KC(110) = K(0) - KC(0) - KC(110), \\ K(330) &= K(220) - KC(220) = K(0) - KC(0) - KC(220) - KC(330), \\ &\vdots \\ K(110n) &= K(0) - \sum_{i=0}^{n} KC(110i) \end{aligned} \tag{6}$$

where "n" is an integer that satisfies the relationship d×n≧L and "i" is an integer that satisfies the inequality 0≦i≦n.

Figure 8:
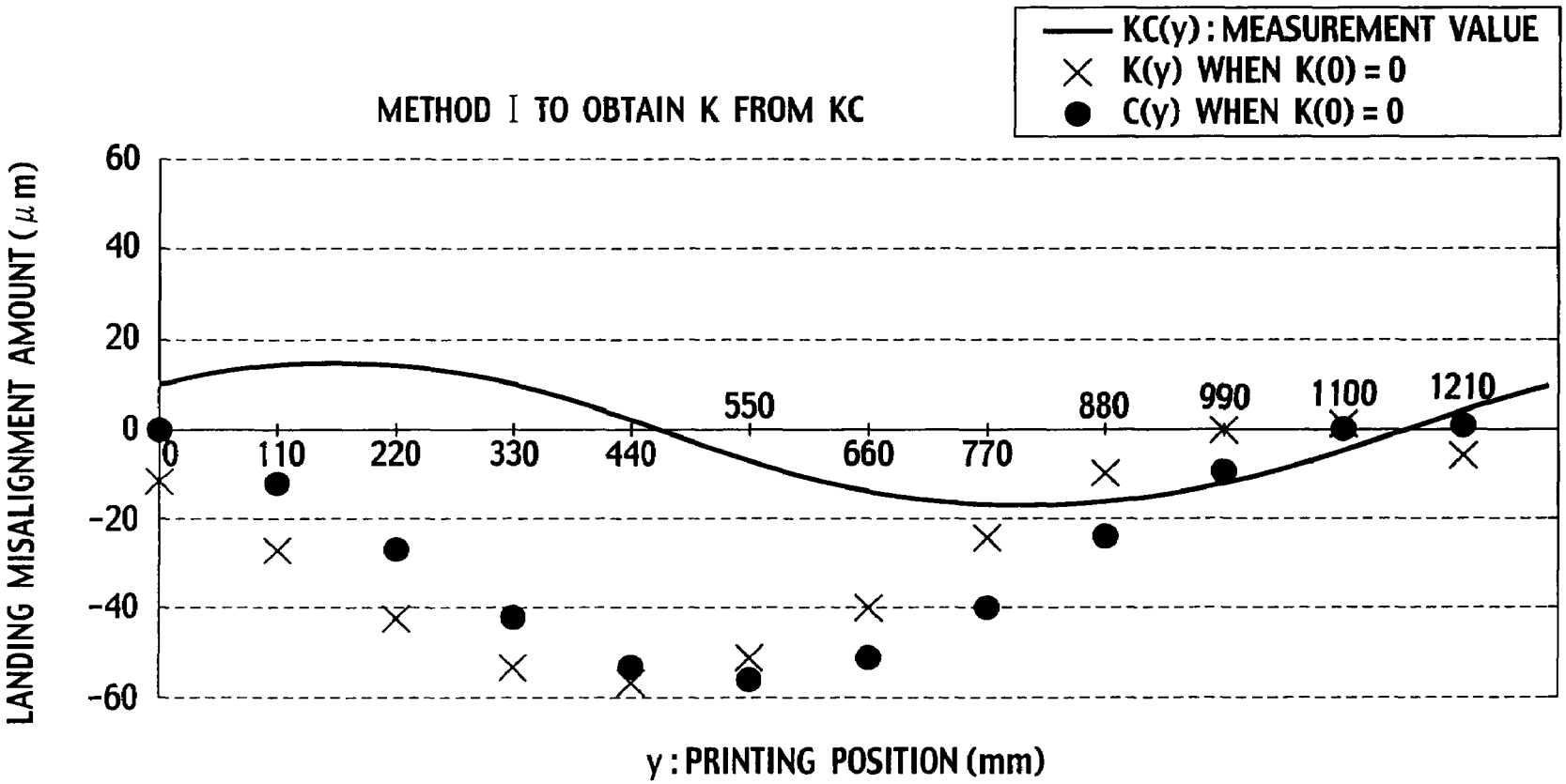
FIG. 8 is a view of the measurement values of a relative landing misalignment amount KC(y), and landing misalignment amounts K(y) and C(y) when K(0)=0.

Thus, by accumulating the measurement value KC(y), we obtain K(y) and C(y) with the interval of 110 mm. In FIG. 8, K(y) is denoted as the symbol "●", and C(y) is denoted as the symbol "X" when K(0)=0. The equation (6) becomes $$K(110n) = -\sum_{i=0}^{n} KC(110i) \tag{7}$$

when K(0)=0.

Figure 9:
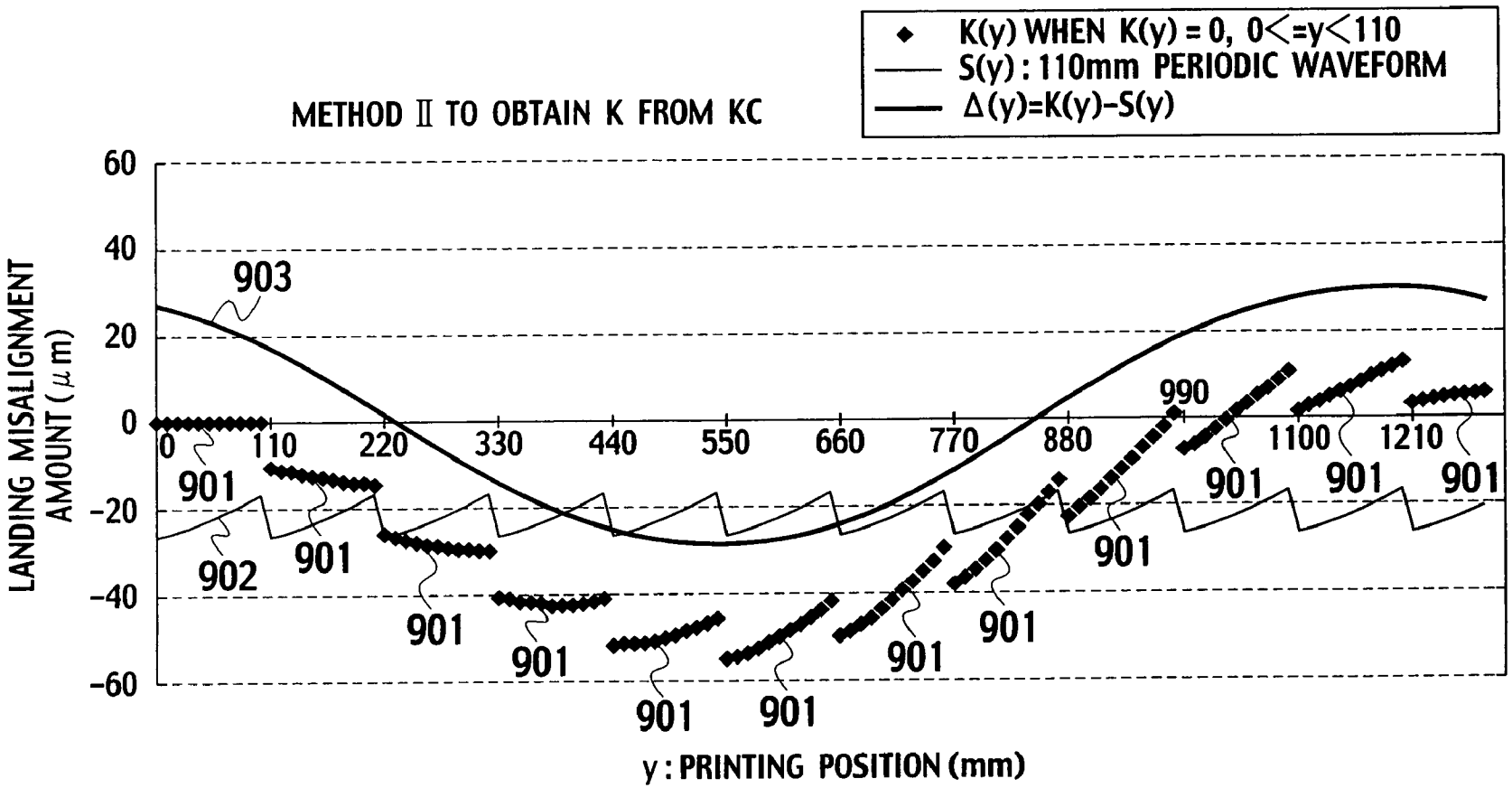
FIG. 9 is a view of K(y) when K(y)=0 where $0 \leqq y < 110$, a wave form S(y) with one cycle (110 [mm]) of K(y), and a landing misalignment amount Δ(y) which is a difference between S(y) and K(y).

It is possible to generalize (6) for arbitrary y=110n+a where "a" is a real number which satisfies the inequality 0≦a≦110. For example, if K(y)=0 for 0≦y<110, we obtain, in the same way to obtain (7), $$K(y) = K(110n + a) = -\sum_{i=0}^{n} KC(110i + a) \tag{8}$$

where "i" is an integer which satisfies the inequality 0≦i≦n. It is shown as a discontinuous function 901 in FIG. 9.

From the discontinuous function 901, we can construct a continuous function $$S(y) = \frac{1}{L}\sum_{i=0}^{L-1} K(110i + m) \tag{9}$$

where "m" represents the remainder of y/110 and "L" the frequency of 110 mm within the belt cycle. In this case, L=12 is set by using a KC(y) wave form with 1320 mm, which is longer than the transfer belt cycle of 1275 mm. This continuous function (9) is shown as a waveform 902 in FIG. 9.

Subtracting (9) from (8), we obtain $$\Delta(y)=K(y)-S(y). \tag{10}$$

This is the very landing misalignment amount of K to be obtained. This function is shown as a continuous function 903 in FIG. 9.

Here is explained (9) in detail. The equations (5-1)-(5-3) show that a 110 mm periodic component of K(y) is canceled from KC(y), KM(y) and KY(y). It is therefore impossible to restore the 110 mm periodic component of K(y). This means that there is no influence on KC(y), KM(y) and KY(y) even though any kind of 110 mm periodic wave is added to or subtracted from K(y). The continuous function S(y) may be considered as an arbitrary wave with 110 mm cycle which makes K(y) continuous. It is however preferable to use the waveform S(y) of (9) so as to prevent the image expansion and contraction of a single color as much as possible.

Since the equations (4-1)-(4-4) show that K(y) only differs from g(y) in phase, it is easy to obtain g(y) from K(y). Storing "−g(y)" as a value in the correction table 37 in the correction circuit 127 and then adjusting the timing of ink-eject from the ink heads 107, 109, 111, 113 enables to eliminate a landing misalignment.

It is possible to create the correction table 37 before product shipment. It is preferable to urge users or service persons to recreate the correction table 37 regularly, such as every one-year, through a display on the image-forming apparatus.

A method of printing in an initial state before measuring the landing misalignment can be any one of the methods:

(a) Printing in a corrected state using a already stored correction table; and (b) Printing in non-corrected state after clearing the already stored correction table.

The method (a) is comprised of:

(1) At the step (1) of FIG. 2, printing the predetermined image pattern in a corrected state with an already used correction table;

(2) At the step (2), measuring a landing misalignment based on the printed predetermined image pattern; and (3) At the step (3), calculating a new correction value based on the measured landing misalignment and adding the new correction value to the already used correction table in the correction circuit 127.

For example, supposing that, although printing with the correction value of +100 μm at a certain position of the transfer belt 105 is done, the landing misalignment amount of −30 μm is still remained. Then, it is possible to add 30 μm to the previous correction value of +100 μm to get the new correction value of +130 μm.

When the transfer belt 105 is used continuously, the method (a) is better because of the less amount of change in correction values. On the other hand, when the transfer belt 105 is exchanged, the method (b) is better because of clearing the previous correction values.

The above initial state makes some gaps (lack of data) corresponding to sheet intervals in measured data of landing misalignment. As an example of initial setting, printing three A3 sheets sequentially with the sheet interval of 50 mm enables to measure the landing misalignment of a length longer than the belt cycle (1275 mm), but makes the two gaps of 50 mm. It is therefore preferable to set appropriate sheet intervals depending on a sheet length and a belt cycle.

As an example of proper setting, printing four A3 sheets with the sheet interval of 220 mm between the first and second sheets and the third and forth sheets and the sheet interval of 535 mm between the second and third sheets enables to measure landing misalignment with no gap in data over the belt cycle (1275 mm) with about 100 mm overlapped.

With a correction value obtained from the above method, it is also possible to eliminate periodical landing misalignment due to unevenness in units other than the transfer unit composed of the transfer belt and the rotary encoder. Such a unit is a cylindrical sheet transfer unit that rotates with clamping a tip of a sheet, a liner encoder with unevenness in a slit or ruled line on the belt surface thereof, or the like.

[Correction Circuit]

The correction circuit 127 shown in FIG. 3 comprises a FPGA (Field Programmable Gate Array), an ASIC (Application Specific Integrated Circuits), and a CPU (Central Processing Unit). Although the correction circuit 127 is separated from the head driving circuit 129 in FIG. 1, it is possible to configure them on an identical device or an identical plate. The belt Lck counter 32 in FIG. 3 selects a collection value from the correction table 37 every 256 lines. It is however preferable to change a correction value more frequently than every 256 lines using a liner interpolation value calculated from anteroposterior correction values.

[Creation of Correction Table]

As described above, a sine wave as the rotational cycle of the transfer belt 105 can be used to create the correction table 37. However, it is also possible to use other waveforms. In addition, it is possible to use a color ink other that K as a reference color ink and to use other calculation methods other than the present calculation method, depending on the size of machines.

Second Embodiment

Figure 10:
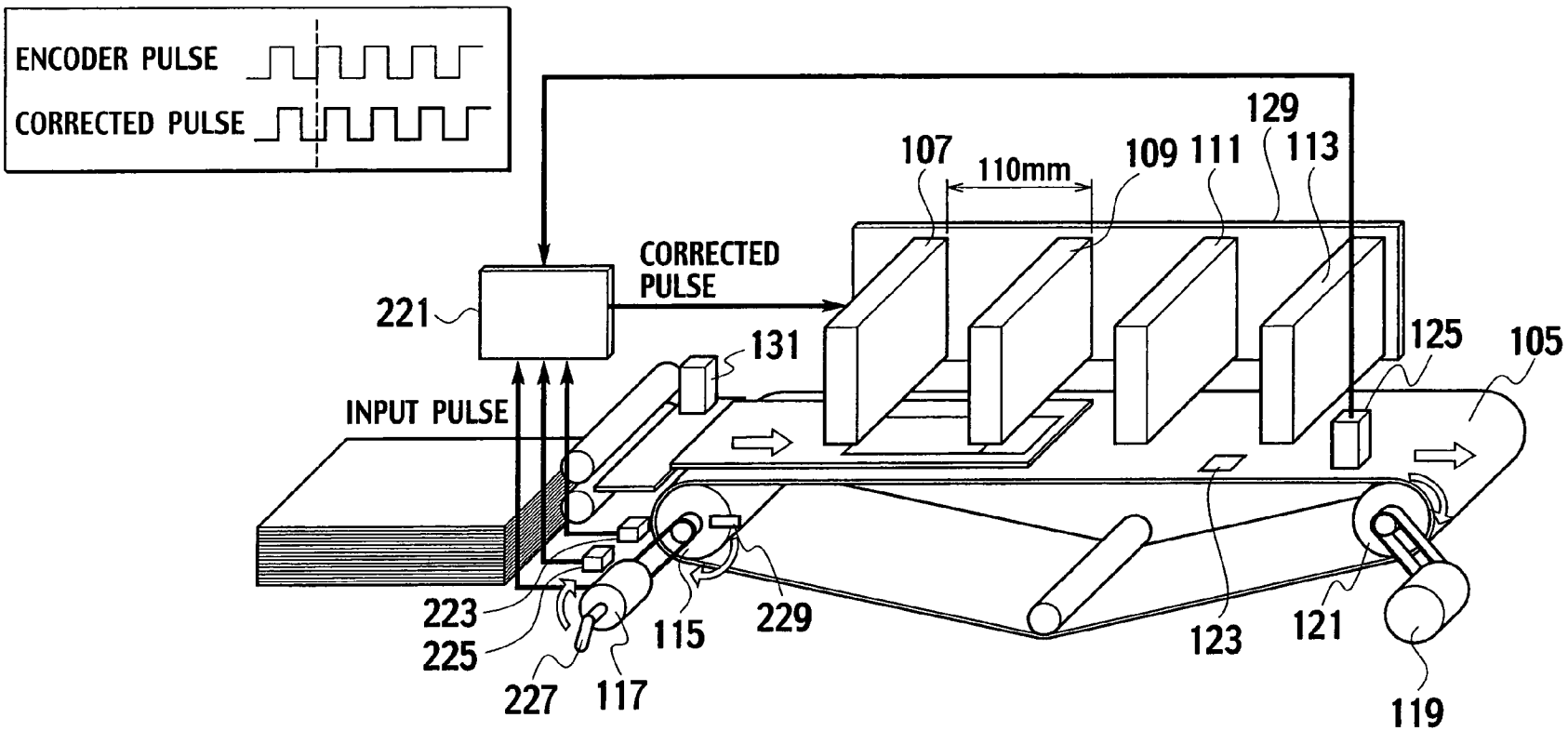
FIG. 10 is a schematic view of an image-forming apparatus according to the second embodiment of the present invention.

FIG. 10 shows a schematic picture of an image forming apparatus according to the second embodiment. This image forming apparatus differs from that according to the first embodiment in FIG. 1 in the following points:

- A roller reference mark 229 and a roller reference sensor 223 are added for the driven roller 115;
- An encoder reference mark 227 and an encoder reference sensor 225 are added for the encoder 117;
- An encoder speed-reducing device (not shown), which makes two rotations of the encoder correspond to one rotation of the roller, is added; and
- The pulse number of the encoder 117 is 750 ppr instead of 1500 ppr.

Compared with the first embodiment, the above structure further enables to correct the unevenness of the driven roller 115 and the encoder 117 and costs less for the encoder 117.

[Outline of Correction Circuit]

Figure 11:
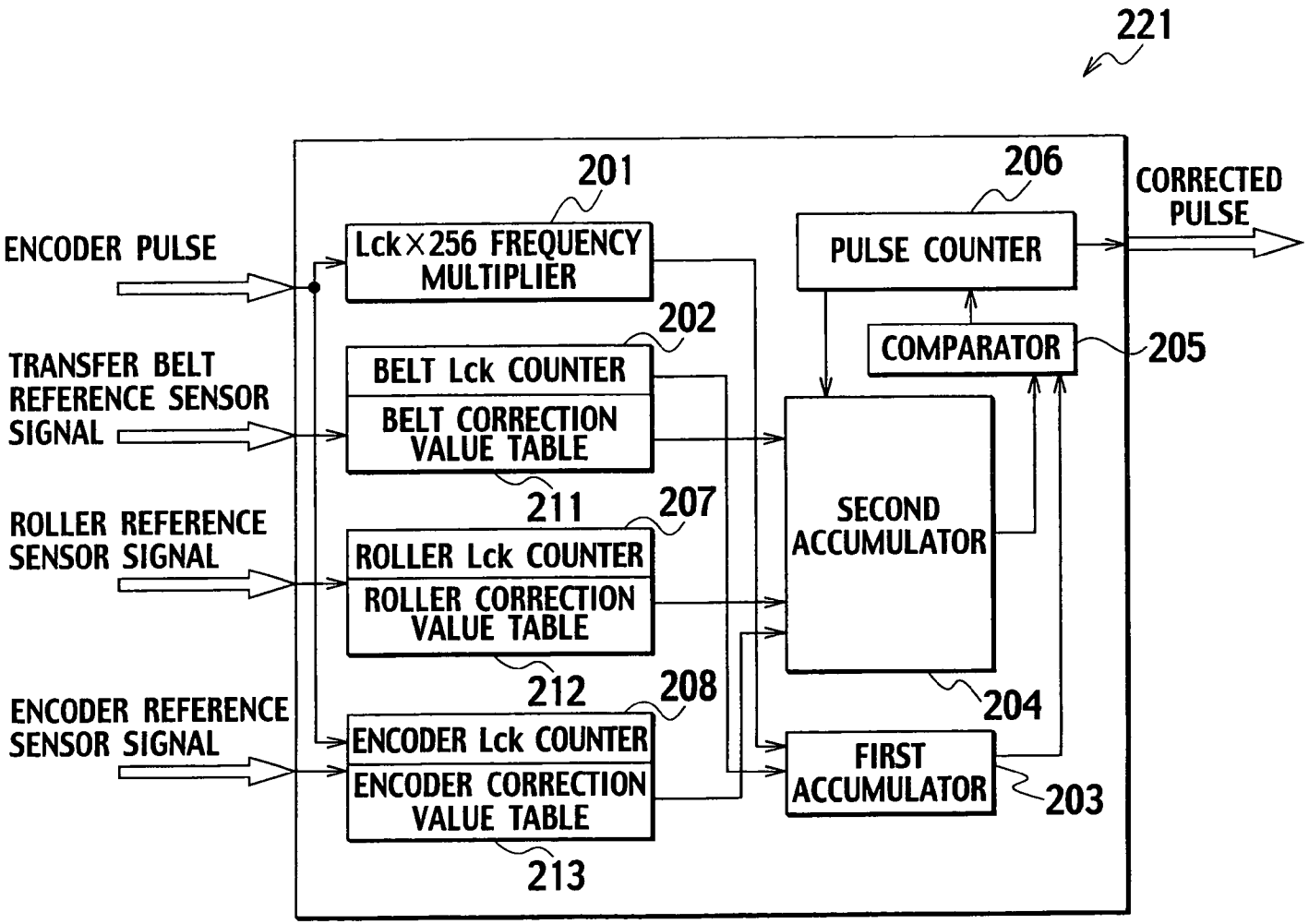
FIG. 11 is a schematic view of the internal structure of a correction circuit according to the second embodiment.

FIG. 11 shows the internal structure of a correction circuit 221 according to the second embodiment. Referring to FIG. 11, there is explained an example of operations of the correction circuit 221.

[Specification of Phase Shifting of Encoder Pulse at Correction Circuit]

- The phase shifting ability is as follows: the dividing ability is 1/256 pulse (0.33 μm) with data of 10 bits per point; the shift range is 0~3.996 pulses (0~338.34 μm).
- The total volume of a correction table for a belt is 640 bits corresponding to 1387 mm, that is, every 256 lines (about 21.7 mm)×64 sections. That of a correction table for a roller is 320 bits corresponding to 173 mm, that is, every 64 lines (about 5.4 mm)×32 sections. That of a correction table for an encoder is 160 bits corresponding to 86 mm, that is, every 64 lines (about 5.4 mm)×16 sections.

There is explained the internal structure of the correction circuit 221.

The correction circuit 221 comprises an Lck counter (not shown), an Lck×256 frequency multiplier 201, a belt Lck counter 202, a roller Lck counter 207, an encoder Lck counter 208, a first accumulator 203, a second accumulator 204, a comparator 205, a pulse counter 206, a correction table for belt (belt correction table) 211, a correction table for roller (roller correction table) 212, and a correction table for encoder (encoder correction table) 213.

The first accumulator 203 adds a counted value of the Lck counter and a counted value of the Lck×256 frequency multiplier 201.

The second accumulator 204 adds respective correction values of the above correction tables 211, 212 and 213 to a value of a counted value of the pulse counter 206 plus 1.

The roller Lck counter 207 is a counter for measuring a current position (of the roller reference mark 229) of the driven roller 115. A correction value (roller correction value) corresponding to the measured current position of the roller reference mark 229 is selected from the roller correction table 212.

The encoder Lck counter 208 is a counter for measuring a current position (of the encoder reference mark 227) of the encoder 117. A correction value (encoder correction value) corresponding to the current position of the encoder reference mark 227 is selected from the encoder correction table 213.

With the above structure, it is possible to shift the phase of the encoder pulse by the total value of the correction values: a belt correction value corresponding to the current position of the transfer belt reference mark 123 of the transfer belt 105; a roller correction value of the driven roller 115; and a encoder correction value of the encoder 117.

[Creation of Correction Table]

There is the unevenness of the rotations of three kinds of transfer units (the transfer belt 105, the roller 115, and the encoder 117). The transfer units have the belt cycle of 1275 mm, the roller cycle of 126 mm, the encoder cycle of 64 mm, respectively.

In the first embodiment, there is explained how to obtain K(y) from KC(y). In the second embodiment, there is explained how to obtain K(y) from KC(y), KM(y) and KY(y) with more accuracy than that of the first embodiment.

Figure 12:
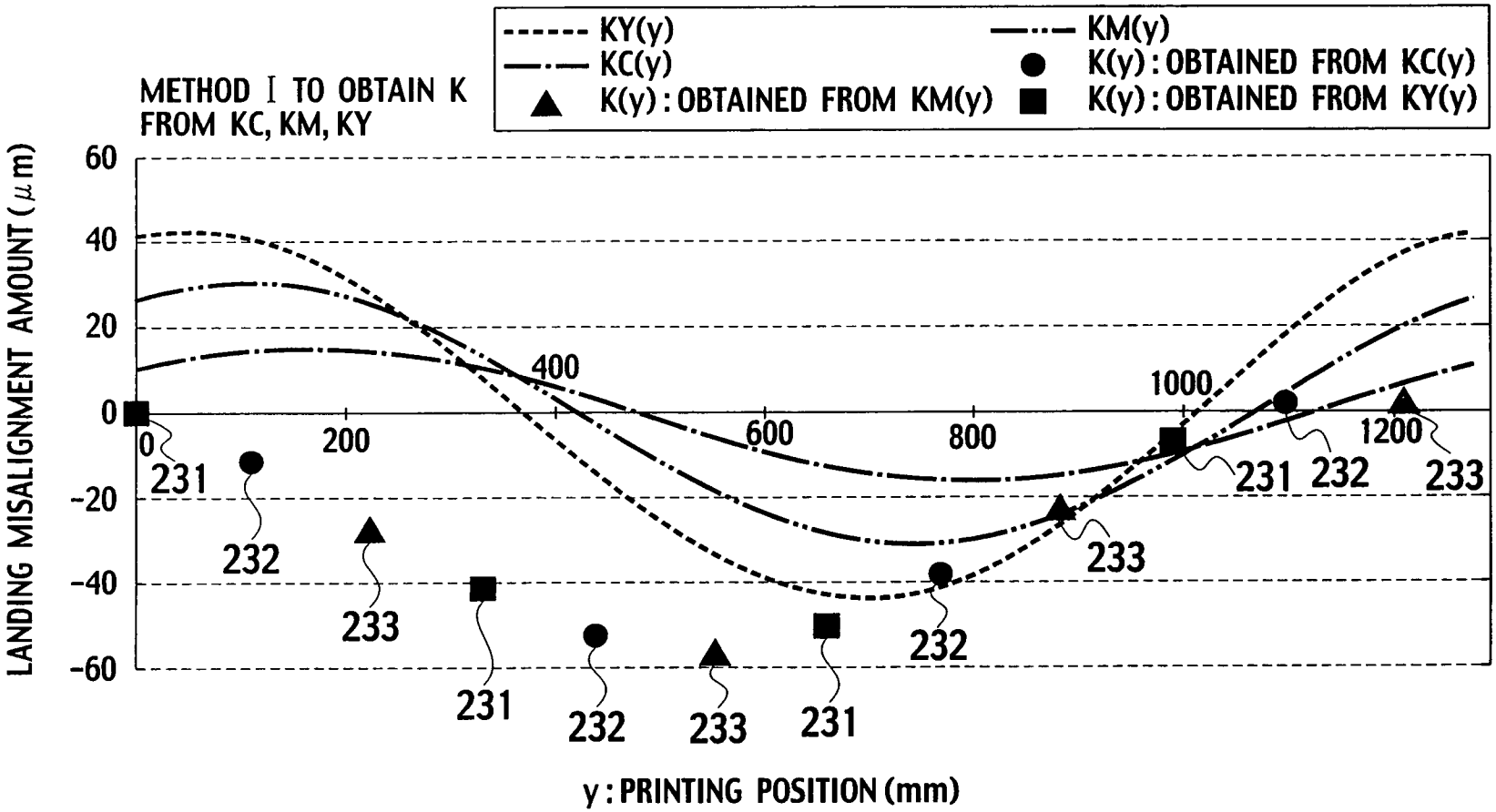
FIG. 12 is a view of landing misalignment amounts KY(y), KM(y), KC(y) and K(y) obtained from KC(y), K(y) obtained from KM(y), and K(y) obtained from KY(y).

Under the condition K(0)=0 as same as the first embodiment, we obtain K(y) for y=330n [mm] (squares 231 with the interval of 330 mm in FIG. 12) using KY(y) as follows:

$$K(330n) = -\sum_{i=0}^{n} KY(110i) \tag{11}$$

where "n" is an integer more than or equal to 0.

Then, using (11), KC(y) and KM(y), we obtain a value shifted by 110 mm from the respective values of (11) (circles 232 in FIG. 12) and a value shifted by 220 mm from the respective values of (11) (triangles 233 in FIG. 12) as follows:

$$K(330n+110)=K(330n)-KC(330n), \tag{12-1}$$

$$K(330n+220)=K(330n)-KM(330n). \tag{12-2}$$

Figure 13:
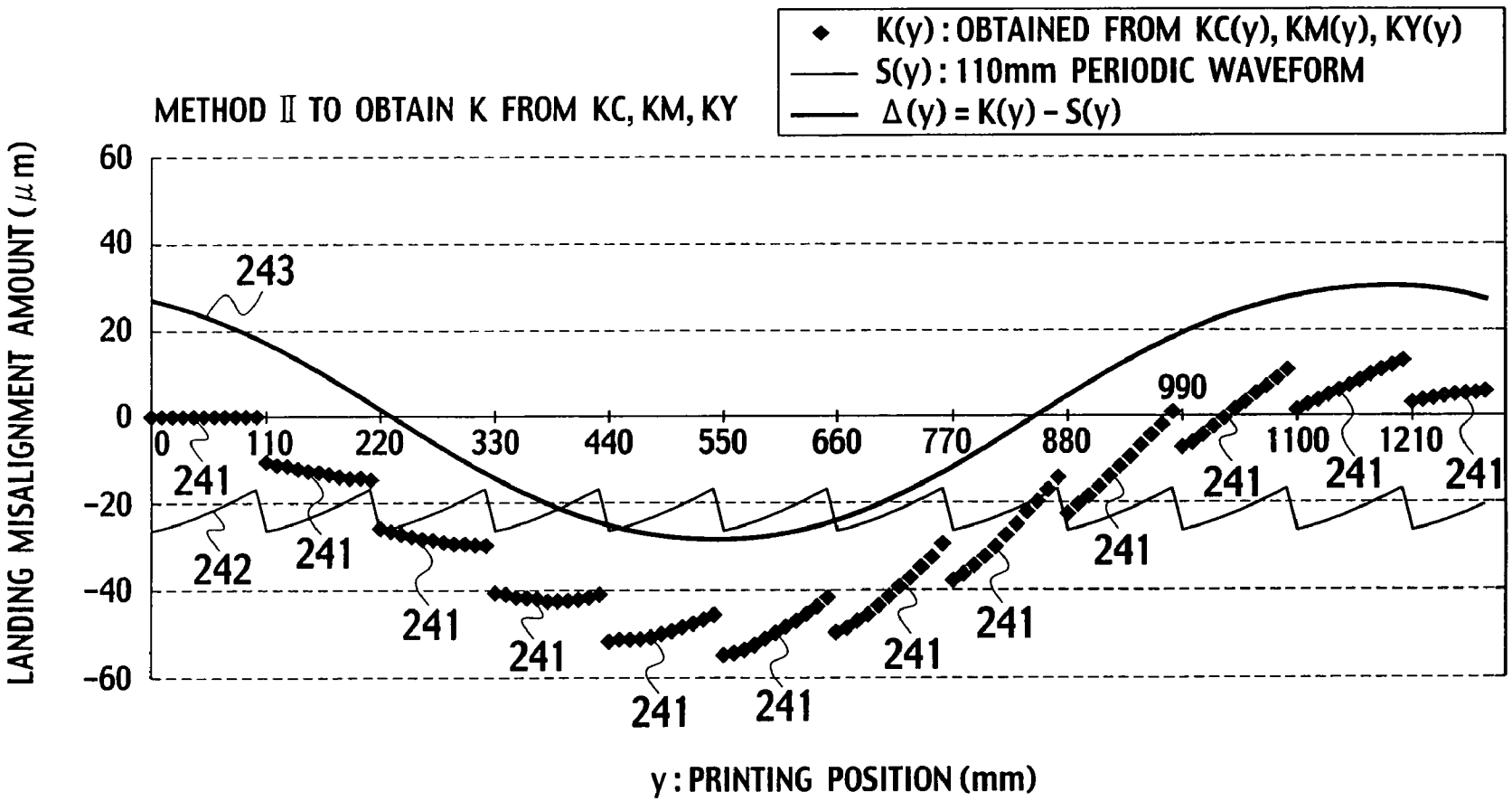
FIG. 13 is a view of K(y) obtained from KY(y), KM(y) and KC(y), a wave form S(y) with one cycle (110 [mm]) of K(y), and a landing misalignment amount Δ(y) which is a difference between K(y) and S(y).

Further, we obtain K(y) and S(y) to get a difference Δ(y) in the same way to obtain K(y) from KC(y) in the first embodiment (expressions (9), (10)). FIG. 13 shows K(y) as a discontinuous function 241, S(y) as a continuous function 242, and the difference Δ(y) as a line 243.

Like this, we can obtain the unevenness of the longest cycle, that is, the belt cycle. This unevenness includes that of the roller cycle (126 mm) and that of the encoder cycle (64 mm). It is therefore possible to extract each cycle of the roller and the encoder from the unevenness of the belt cycle to create each correction table: the belt correction table 211; the roller correction table 212; and the encoder correction table 213.

There is no need to provide the encoder reference position sensor 225 and the encoder correction table 213 when the position of the roller reference mark 229 and the position of the encoder reference mark 227 are not to be misaligned.

Figure 14A:
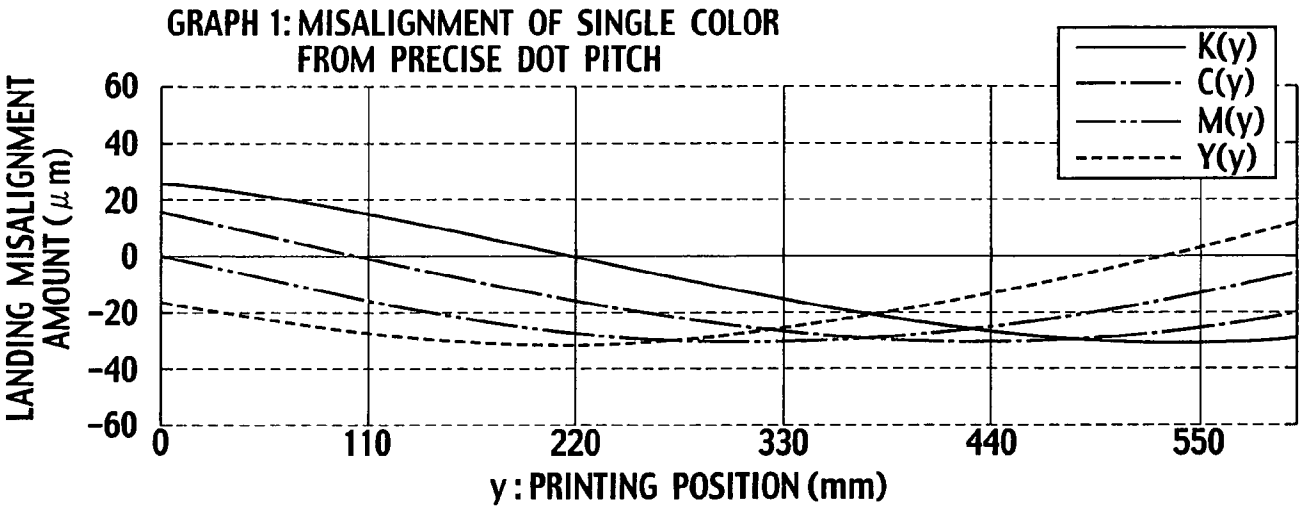
FIG. 14A is a view of the landing misalignment amounts of K, C, M and Y from a precise dot pitch.
Figure 14B:
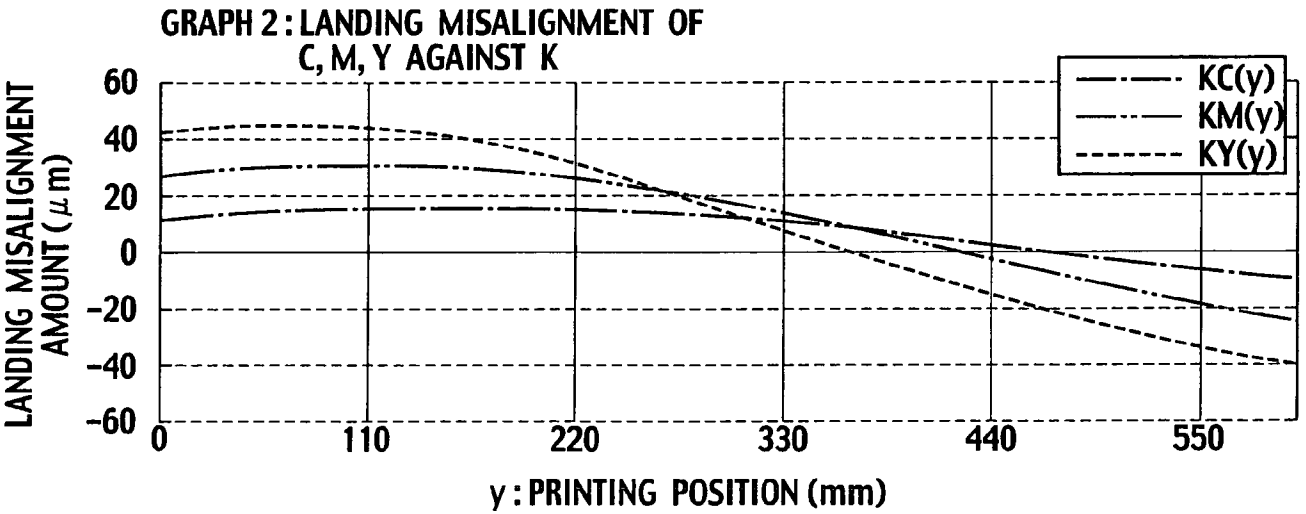
FIG. 14B is a view of the landing misalignment amounts of C, M and Y relative to that of K.
Figure 14C:
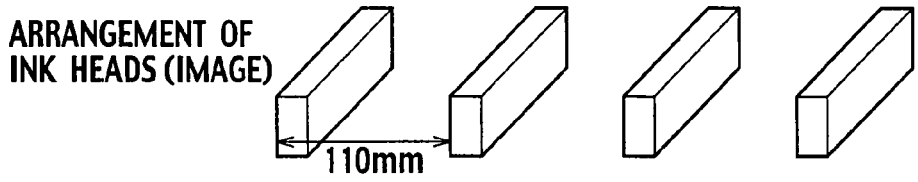
FIG. 14C is a view of an arrangement of ink heads.
Figure 14D:
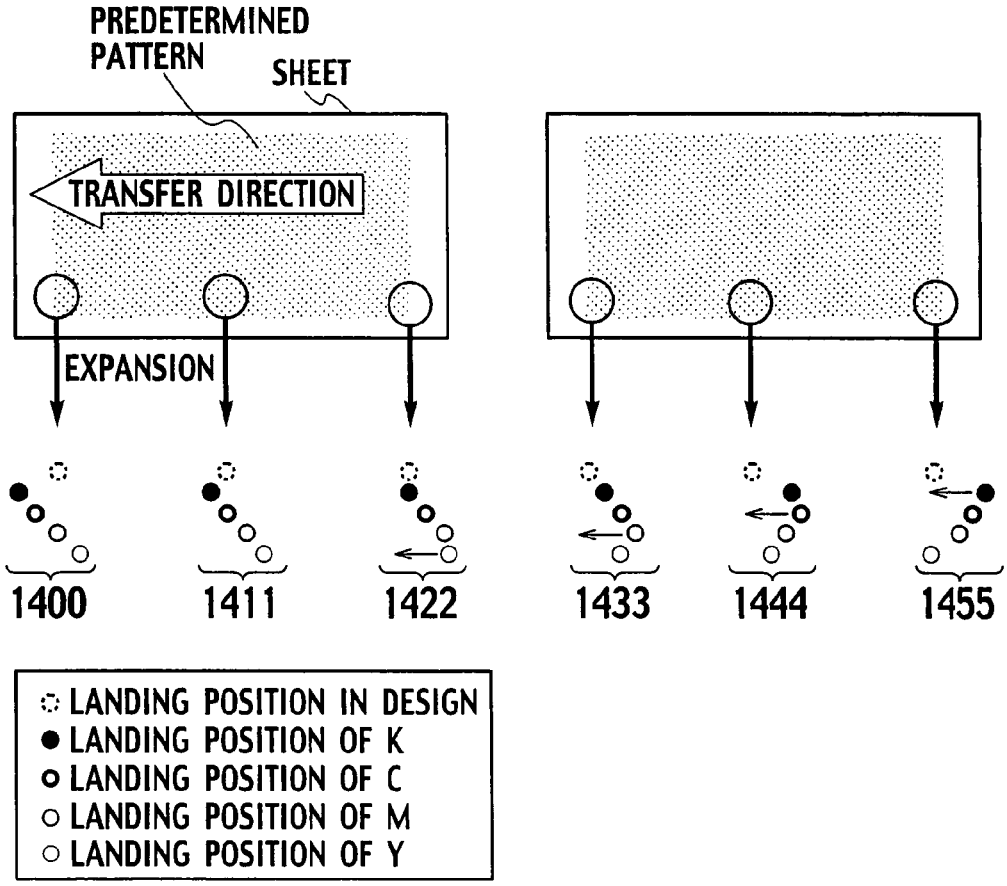
FIG. 14D is a view of a landing position in design and landing positions of K, C, M and Y.

FIG. 14A shows the landing misalignment amounts of K, C, M and Y from a precise dot pitch. FIG. 14B shows the landing misalignment amount of C, M and Y from K. FIG. 14C shows an arrangement of ink heads. FIG. 14D shows a landing position in design and landing positions of K, C, M and Y.

Firstly, the printing position of y=0 mm is explained.

As shown in FIG. 14A, at the printing position y=0 mm, the landing misalignment amount of K is more than 20 μm, that of C is less than 20 μm, that of M is 0 μm, and that of Y is less than −20 μm.

As shown in FIG. 14B, at the printing position y=0 mm, the landing misalignment amount of C from K is less than 20 μm, that of M from K is more than 20 μm, and that of Y from K is more than 40 μm.

FIG. 14D shows the landing position in design and the landing positions of K, C, M and Y (1400) at the printing position of y=0 mm.

Next, the printing position of y=110 mm is explained.

As shown in FIG. 14A, at the printing position y=110 mm, the landing misalignment amount of K is less than 20 μm, that of C is 0 μm, that of M is less than −20 μm, and that of Y is more than −20 μm.

As shown in FIG. 14B, at the printing position y=110 mm, the landing misalignment amount of C from K is less than 20 μm, that of M from K is more than 20 μm, and that of Y from K is more than 40 μm.

FIG. 14D shows the landing position in design and the landing positions of K, C, M and Y (1411) at the printing position of y=110 mm.

Next, the printing position of y=220 mm is explained.

As shown in FIG. 14A, at the printing position y=220 mm, the landing misalignment amount of K is 0 μm, that of C is less than −20 μm, that of M is more than −20 μm, and that of Y is −30 μm.

As shown in FIG. 14B, at the printing position y=220 mm, the landing misalignment amount of C from K is less than 20 μm, that of M from K is more than 20 μm, and that of Y from K is 30 μm.

FIG. 14D shows the landing position in design and the landing positions of K, C, M and Y (1422) at the printing position of y=220 mm.

Next, the printing position of y=330 mm is explained.

As shown in FIG. 14A, at the printing position y=330 mm, the landing misalignment amount of K is less than −20 μm, that of C is more than −20 μm, that of M is −30 μm, and that of Y is more than −20 μm.

As shown in FIG. 14B, at the printing position y=330 mm, the landing misalignment amount of C from K is less than 20 μm, that of M from K is less than 20 μm, and that of Y from K is less than 20 μm.

FIG. 14D shows the landing position in design and the landing positions of K, C, M and Y (1433) at the printing position of y=330 mm.

Next, the printing position of y=440 mm is explained.

As shown in FIG. 14A, at the printing position y=440 mm, the landing misalignment amount of K is more than −20 μm, that of C is −30 μm, that of M is more than −20 μm, and that of Y is less than −20 μm.

As shown in FIG. 14B, at the printing position y=440 mm, the landing misalignment amount of C from K is less than 20 μm, that of M from K is less than −20 μm, and that of Y from K is less than −20 μm.

FIG. 14D shows the landing position in design and the landing position of K, C, M and Y (1444) at the printing position of y=440 mm.

Next, the printing position of y=550 mm is explained.

As shown in FIG. 14A, at the printing position y=550 mm, the landing misalignment amount of K is −30 μm, that of C is more than −20 μm, that of M is less than −20 μm, and that of Y is less than 20 μm.

As shown in FIG. 14B, at the printing position y=550 mm, the landing misalignment amount of C from K is less than −20 μm, that of M from K is less than −20 μm, and that of Y from K is more than −20 μm.

FIG. 14D shows the landing position in design and the landing positions of K, C, M and Y (1455) at the printing position of y=550 mm.

As described above, the landing misalignment amount of Y from the landing position in design at the printing position y=220 mm is −30 μm, the landing misalignment amount of M from the landing position in design at the printing position y=330 mm is −30 μm, the landing misalignment amount of C from the landing position in design at the printing position y=440 mm is −30 μm, and the landing misalignment amount of K from the landing position in design at the printing position y=550 mm is −30 μm.

Shifting the timing of ejecting the ink Y earlier by 30 μm at the printing position y=220 mm enables to shift: the timing of ejecting the ink M earlier by 30 μm at the printing position y=330 mm, which is 110 mm apart from the printing position y=220 mm; the timing of ejecting the ink C earlier by 30 μm at the printing position y=440 mm, 220 mm apart; and the timing of ejecting the ink K earlier by 30 μm at the printing position y=550 mm, 330 mm apart. As a result, all the color inks come to land at the position in design.

Figure 15A:
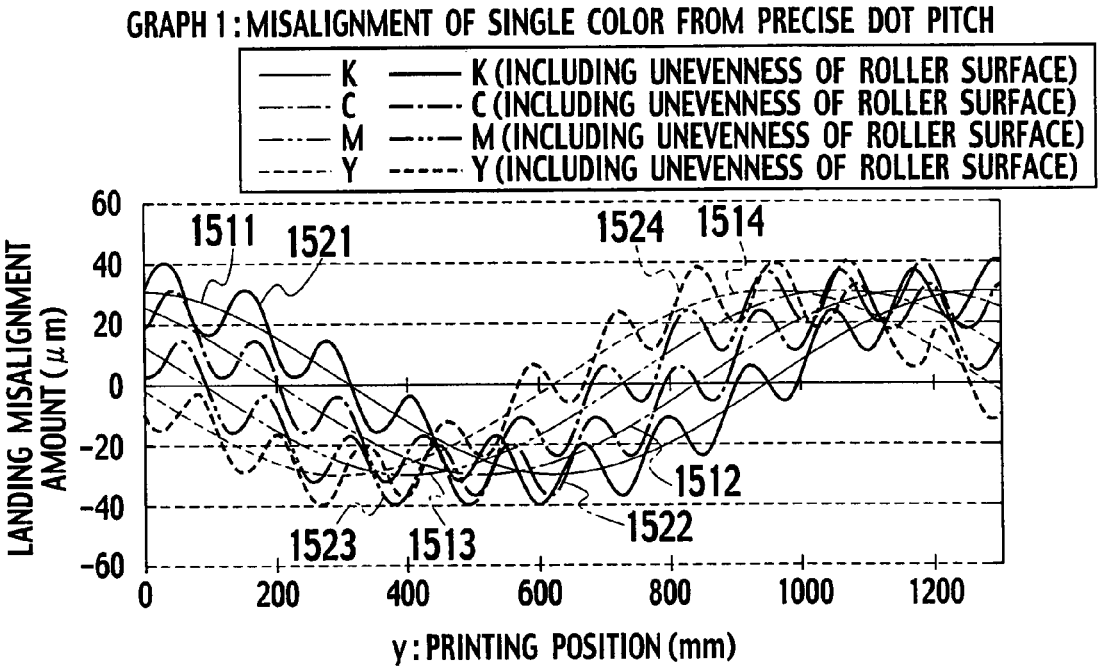
FIG. 15A is a view of the total landing misalignment amounts of K, C, M and Y, from a landing position in design, each of which is a landing misalignment amount with a belt cycle plus a landing misalignment amount with a roller cycle.

FIG. 15A shows the total landing misalignment amount of K, C, M and Y from a landing position in design, each of which is a landing misalignment amount with the belt cycle plus a landing misalignment amount with the roller cycle.

A thin line 1511 represents the landing misalignment amounts of K with the belt cycle, a thin line 1512 that of C with the belt cycle, a thin line 1513 that of M with the belt cycle, and a thin line 1514 that of Y with the belt cycle.

A thick line 1521 represents the total of the landing misalignment amount of K with the belt cycle and that with the roller cycle, a thick line 1522 that of C with the belt cycle and that with the roller cycle, a thick line 1523 that of M with the belt cycle and that with the roller cycle, and a thick line 1524 that of Y with the belt cycle and that with the roller cycle.

Figure 15B:
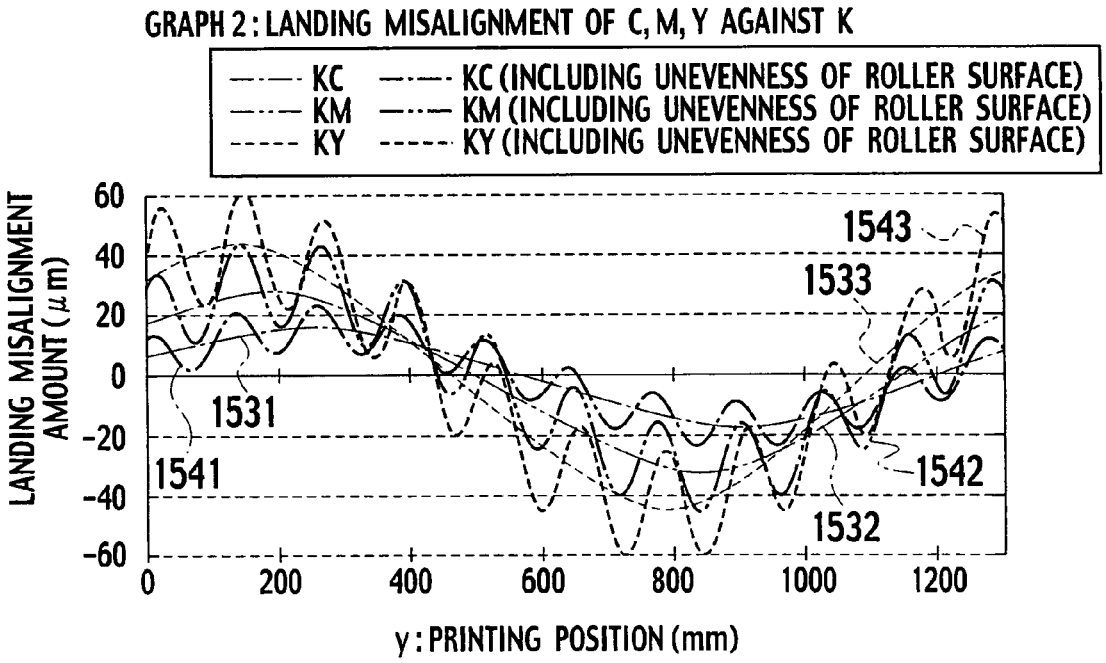
FIG. 15B is a view of the total landing misalignment amounts of C, M and Y relative to that of K.

FIG. 15B shows the total landing misalignment amounts of C, M and Y relative to that of K, as same as in FIG. 15A.

A thin line 1531 represents the landing misalignment amount of C from K with the belt cycle, a thin line 1532 that of M from K with the belt cycle, and a thin line 1533 that of Y from K with the belt cycle.

A thick line 1541 represents the total of the landing misalignment amount of C from K with the belt cycle and that with the roller cycle, a thick line 1542 that of M from K with the belt cycle and that with the roller cycle, and a thick line 1543 that of Y from K with the belt cycle and that with the roller cycle.

As described above, a total landing misalignment amount that includes a landing misalignment amount with the roller cycle is shown as the thick lines 1541, 1542 and 1543 in FIG. 15B. Supposing KC(y) as the thick line 1541 representing the landing alignment amount of C relative to that of K, KM(y) as the thick line 1542 representing the landing alignment amount of M relative to that of K, and KY(y) as the thick line 1543 representing the landing alignment amount of Y relative to that of K, we obtain the waveforms Rkc(y), Rkm(y) and Rky(y) with the cycle of 126 mm such that $$Rkc(y) = \frac{1}{P}\sum_{i=0}^{P-1} kc(126i + q), \tag{13-1}$$

$$Rkm(y) = \frac{1}{P}\sum_{i=0}^{P-1} km(126i + q), \tag{13-2}$$

$$Rky(y) = \frac{1}{P}\sum_{i=0}^{P-1} ky(126i + q) \tag{13-3}$$

where "q" represents the remainder of y/126 and "P" the frequency of 126 mm in the cycle (1275 mm) of the transfer belt cycle. In this case, P=10≈1275/126.

Figure 15C:
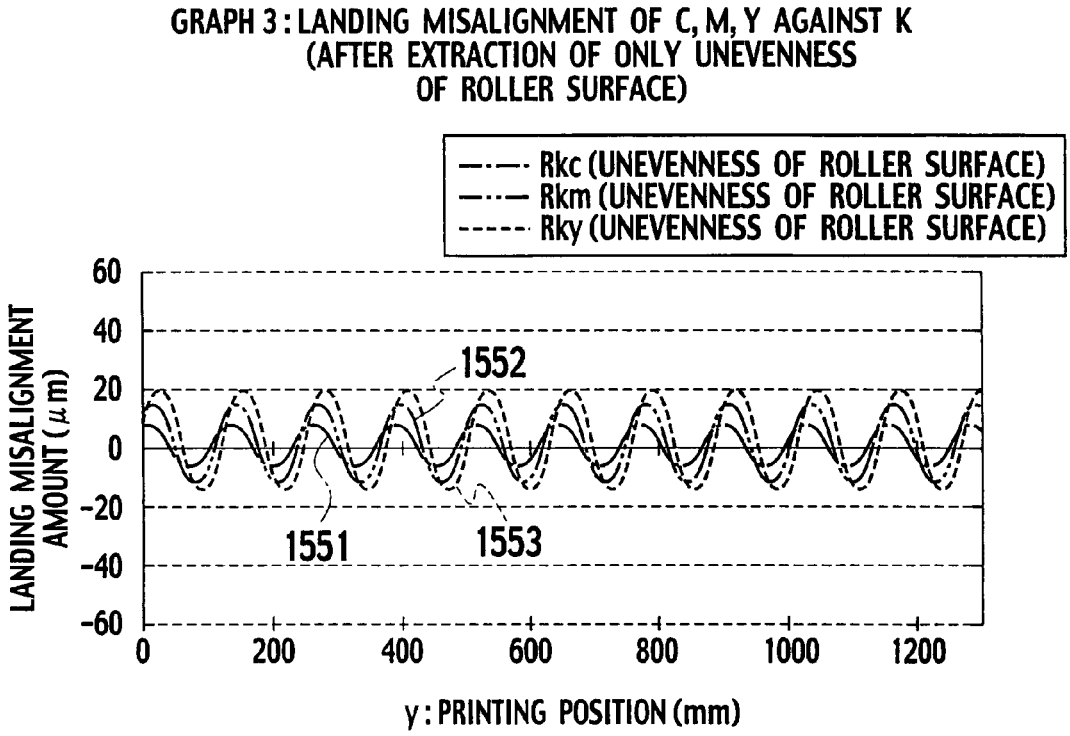
FIG. 15C is a view of the landing misalignment amounts with the belt cycle of C, M and Y relative to that of K, each of which is the total landing misalignment amount minus the landing misalignment amount with the roller cycle.

FIG. 15C shows the landing misalignment amounts with the roller cycle of C, M and Y relative to that of K, each of which is the total landing misalignment amount minus the landing misalignment amount with the roller cycle. A dotted line 1551 represents Rkc(y) obtained from (13-1), a dotted line 1552 Rkm(y) obtained from (13-2), and a dotted line 1553 Rky(y) obtained from (13-3). As the above, when the cycle of a landing misalignment is known, it is possible to extract the landing misalignment amount with the cycle.

The above (7) to (12-1), (12-2) are for a method to obtain the table of correction values K(y) from arbitrary relative landing misalignment. By applying this method to the dotted lines 1551-1553 in FIG. 15C, it is possible to obtain correction values with the roller cycle. The method is explained below.

[Method to Obtain K from KC]

Supposing Rkc(y) as KC(y) in (7), we obtain K(y) using (7)~(10). K(y) for y=0~126 mm is the correction values of the roller correction table 212.

[Method to Obtain K from KC, KM, KY]

Supposing Rky(y) as KY(y) in (1), Rkc(y) as KC(y) in (2), and Rkm(y) as KM(y) in (2), we obtain K(y) using (9), (10). K(y) for y=0~126 mm is the correction values of the roller correction table 212.

As is clear from the above explanation, according to the present invention, it is possible to eliminate a landing misalignment by correcting a timing of ink-ejection from an ink head depending on a rotational position of a rotational component.

It should be noted that the above explanation is just done with several examples, so that the technical scope of the invention is not limited by them.

For example, K(y) is obtained using KC(y) in the first embodiment. However with Fourier transformation, it is possible to obtain respective graphs of K(y) of the three kinds of transfer units in any of the following methods:

(1) Obtaining K(y) by using each graph of the cycles (64 mm, 1.26 mm, and 1275 mm) which is extracted from KC(y).

(2) Extracting each cycle (64 mm, 1.26 mm, and 1.275 mm) from K(y) to be obtained. In particular, the methods are as indicated below.

In the method (1), there are obtained three KC(y)s from one KC(y): the cycle of 64 mm extracted from KC(y), the cycle of 126 mm extracted from KC(y), and the cycle of 1275 mm extracted from KC(y). Then, from the three KC(y)s, there are created three tables of correction values respectively: the correction table K(y) for encoder; the correction table K(y) for roller, and the correction table K(y) for belt.

In the method (2), there is obtained one K(y) from one KC(y). From the one K(y), there are obtained three K(y)s: "the cycle of 64 mm extracted from the one K(y)"; "the cycle of 126 mm extracted from the one K(y)"; and "the cycle of 1275 mm extracted from the one K(y)".

This application is based on the Japanese Patent Applications No. 2006-106252, filed on Apr. 7, 2006, the entire content of which is incorporated by reference herein.

What is claimed is:

1. An image-forming apparatus comprising:

a transfer unit that transfers an image-formed medium by rotation thereof;

an image-forming unit that includes a first ink head and a second ink head arranged in a transfer direction of the image-formed medium at a predetermined interval and controls the first and second ink heads to eject first and second inks on the image-formed medium;

a transfer amount detecting unit that outputs a pulse signal in response to a rotational motion of the transfer unit;

a transfer reference position detecting unit that detects a reference position provided on the transfer unit;

an ink landing position calculating unit that calculates an ink landing position corresponding to the reference position on the image-formed medium by counting a pulse signal after detection of the reference position;

a storage unit that stores correction values for printing timing for one rotational cycle of the transfer unit as a correction table; and a printing timing signal generating unit that reads out a correction value for printing timing, which corresponds to the ink landing position on the image-formed medium, from the correction table and generates a printing timing signal by shifting a phase of the pulse signal by the correction value for printing timing;

wherein the correction table includes a set of values, each value being calculated based on a measurement value of an interval between a first ink landing position by the first ink head and a second ink landing position by the second ink head in a predetermined image pattern formed on the predetermined image-formed media which are corresponding to a length longer than the one rotational cycle of the transfer unit, and canceling an error of a transfer amount of the predetermined image-formed media by the transfer unit, and wherein the image-forming unit forms an image on the image-formed medium in transfer by controlling the first and second ink heads to eject the first and second inks in synchronization with the printing timing signal.

2. The image-forming apparatus of claim 1, wherein the error of the transfer amount of the predetermined image-formed media is calculated by $$K(d \times n) = -\sum_{i=0}^{n} KC(d \times i)$$

from relationships KC(y)=K(y)−C(y), C(y)=K(y+d) and a condition K(0)=0, where "d" is an interval between the first ink head and the second ink head;

"L" a length of the one rotational cycle of the transfer unit;

"K(y)" a landing misalignment of the first ink ejected by the first ink head at a landing position in design "y" on the predetermined image-formed media;

"C(y)" a landing misalignment of the second ink ejected by the second ink head at the landing position in design "y" on the predetermined image-formed media;

"KC(y)" a relative landing misalignment between the first ink ejected by the first ink head and the second ink ejected by the second ink head at the landing position in design "y" on the predetermined image-formed media; and "n" an integer which satisfies a relationship d×n>=L.

3. The image-forming apparatus of claim 2, further comprising:

a register unit that registers and sends the predetermined image-formed media to the transfer unit so as to start ink-ejecting from the first ink head at a landing position in design y=0 on the predetermined image-formed media with satisfying the condition: K(0)=0.

4. The image-forming apparatus of claim 1, wherein the transfer unit includes a first transfer section that transfers an image-formed medium by rotation thereof, and a second transfer section that transfers the image-formed medium by rotation thereof, the transfer reference position detecting unit includes a first transfer reference position detecting section that detects a first reference position provided on the first transfer section, and a second transfer reference position detecting section that detects a second reference position provided on the second transfer section, the ink landing position calculating unit includes: a first ink landing position calculating section that calculates an ink landing position corresponding to the first reference position on the image-formed media by counting the pulse signal after detection of the first reference position; and a second ink landing position calculating section that calculates an ink landing position corresponding to the second reference position on the image-formed media by counting the pulse signal after detection of the second reference position, the storage unit includes: a first storage section that stores correction values for printing timing for one rotational cycle of the first transfer section as a first correction table; and a second storage section that stores correction values for printing timing for one rotational cycle of the second transfer section as a second correction table, and the correction table includes the first and second correction tables.

* * * * *